United States Patent [19]

Matthews

[11] 3,971,637

[45] July 27, 1976

[54] COAL GASIFICATION PROCESS UTILIZING WASTE WATER FROM AN EXTERNAL PROCESS

[75] Inventor: Charles W. Matthews, Pittsburgh, Pa.

[73] Assignee: Gulf Oil Corporation, Pittsburgh, Pa.

[22] Filed: Dec. 23, 1974

[21] Appl. No.: 536,010

[52] U.S. Cl. ..... 48/202; 48/197 R; 48/206; 252/373

[51] Int. Cl.[2] ..... C10B 1/04; C10J 3/54; C10J 3/56; C10K 1/08

[58] Field of Search ..... 48/197, 202, 203, 206, 48/209, 210, 215, 99, 101, 73, 76, 77, 85; 252/373; 201/30

[56] References Cited

UNITED STATES PATENTS

| | | | |
|---|---|---|---|
| 2,662,007 | 12/1953 | Dickinson | 48/206 |
| 2,698,782 | 1/1955 | Coghlan | 48/197 R X |
| 2,729,552 | 1/1956 | Nelson et al. | 48/197 R |
| 2,803,530 | 8/1957 | Ludeman | 48/206 |
| 2,838,388 | 6/1958 | Carkeek et al. | 48/206 |
| 2,879,148 | 3/1959 | Atwell | 48/197 R |
| 2,914,391 | 11/1959 | Stratford | 48/197 R X |
| 3,544,291 | 12/1970 | Schlinger et al. | 48/206 |
| 3,607,157 | 9/1971 | Schlinger et al. | 48/202 X |
| 3,746,522 | 7/1973 | Donath | 48/202 |
| 3,782,913 | 1/1974 | Donath | 48/202 |
| 3,867,110 | 2/1975 | Schora et al. | 48/210 |

*Primary Examiner*—Morris O. Wolk
*Assistant Examiner*—Michael S. Marcus

[57] ABSTRACT

A process for gasifying coal to produce carbon monoxide and hydrogen in which a first stream of coal is burned without bed formation in a combustion zone in the presence of water under oxidation conditions to produce gases comprising carbon dioxide and steam. A second stream of coal is maintained as a fluid bed in a separate gasifier zone by upflowing carbon dioxide and steam from the combustion zone while being gasified under reducing conditions to produce carbon monoxide and hydrogen. A foul water stream from an external process containing pollutants and/or dissolved salts is charged to the combustion zone resulting in combustion of pollutants and slagging of dissolved salts contained therein.

4 Claims, 1 Drawing Figure

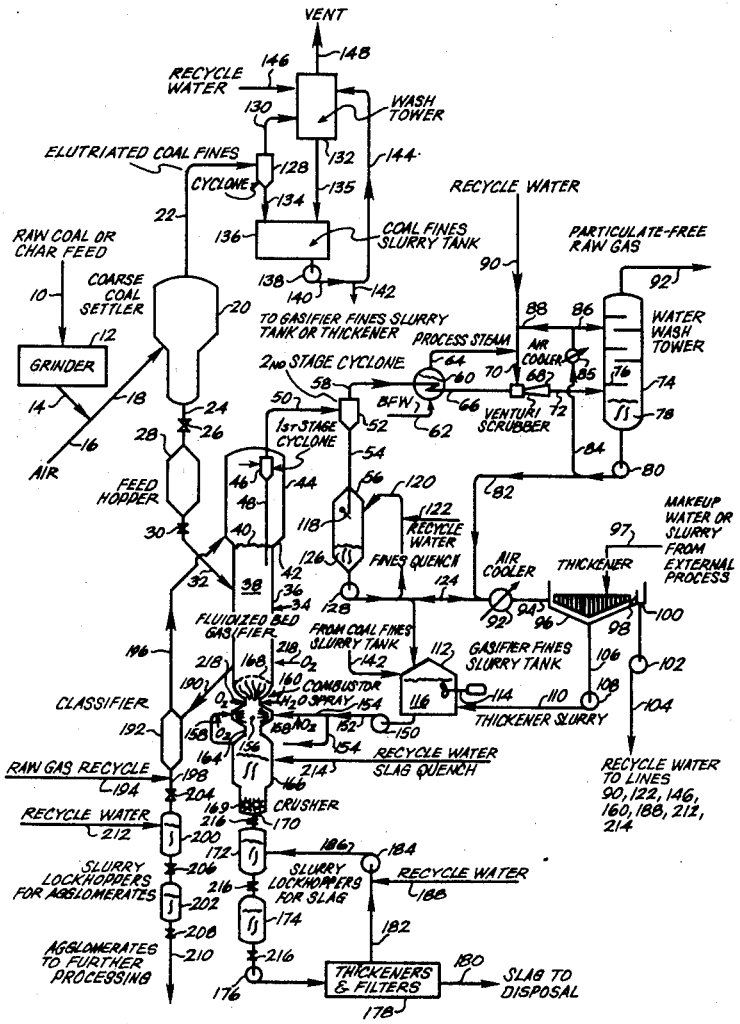

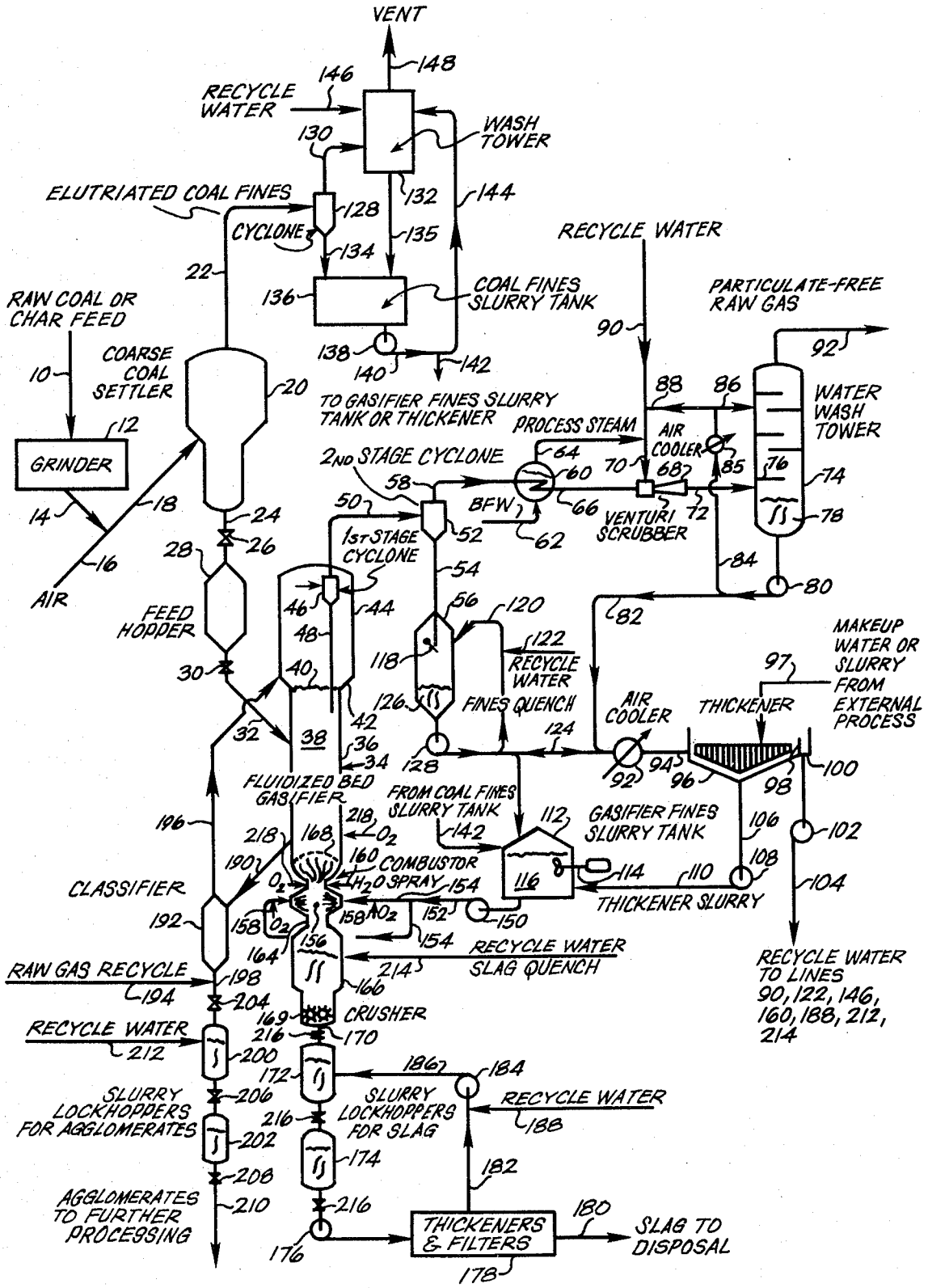
VENT
RECYCLE WATER
WASH TOWER
ELUTRIATED COAL FINES
CYCLONE
COAL FINES SLURRY TANK
RECYCLE WATER
PARTICULATE-FREE RAW GAS
RAW COAL OR CHAR FEED
COARSE COAL SETTLER
TO GASIFIER FINES SLURRY TANK OR THICKENER
PROCESS STEAM
AIR COOLER
WATER WASH TOWER
GRINDER
2ND STAGE CYCLONE
BFW
VENTURI SCRUBBER
1ST STAGE CYCLONE
AIR
FEED HOPPER
RECYCLE WATER
FINES QUENCH
AIR COOLER
THICKENER
MAKEUP WATER OR SLURRY FROM EXTERNAL PROCESS
FLUIDIZED BED GASIFIER
FROM COAL FINES SLURRY TANK
GASIFIER FINES SLURRY TANK
COMBUSTOR
H2O SPRAY
CLASSIFIER
THICKENER SLURRY
RECYCLE WATER SLAG QUENCH
RAW GAS RECYCLE
CRUSHER
RECYCLE WATER TO LINES 90, 122, 146, 160, 188, 212, 214
RECYCLE WATER
SLURRY LOCKHOPPERS FOR AGGLOMERATES
SLURRY LOCKHOPPERS FOR SLAG
RECYCLE WATER
AGGLOMERATES TO FURTHER PROCESSING
THICKENERS & FILTERS
SLAG TO DISPOSAL

COAL GASIFICATION PROCESS UTILIZING WASTE WATER FROM AN EXTERNAL PROCESS

This invention relates to a process for gasifying coal, coke, or other carbonaceous solids to produce a gaseous mixture which, after removal of carbon dioxide and hydrogen sulfide, is composed mainly of carbon monoxide and hydrogen. The gaseous product may be utilized as a moderate Btu-content fuel; as a reducing gas for metallurgical or chemical purposes; and as an intermediate for conversion to hydrogen for use in chemical processes, in petroleum refineries, in coal conversion plants for manufacture of coal liquids or high Btu-content gas.

In accordance with the present invention, coal is converted to carbon monoxide and hydrogen by a process which exhibits a minimum potential for polluting. Essentially no water effluent is produced. Water makeup for use within the process as steam for gasification or as wash water may include polluted, solids-containing water from other processes. As a result, process requirements for fresh water are greatly reduced, and conventional requirements for purification and discharge of process waste water are similarly reduced.

Ash, entering as part of the coal feed, is removed from the process in the oxidized form as solidified slag, suitable for landfill or for additional processing to recover valuable minerals. Noncombustible solids introduced in water makeup from other processes or in raw water are also removed as part of the oxidized, solidified slag. Essentially no ash or other solids is rejected to the atmosphere.

Gaseous impurities, having a potential for pollution, which are generated within the process are treated within the process and converted into acceptable forms for sale or disposal, or the impurities are destroyed within the process. For example, sulfur compounds entering the process are converted to hydrogen sulfide directly, or to sulfur dioxide and then to hydrogen sulfide; the hydrogen sulfide is recovered by known processes; and the recovered hydrogen sulfide is converted to elemental sulfur for sale or storage by use of known processes. Nitrogen compounds entering the process are converted mainly into ammonia, or to nitrogen gas, or to nitrogen oxides and then to ammonia or nitrogen gas; the ammonia is recovered and purified by known processes for sale. Gas streams before venting are first water scrubbed within the process to remove all dust and particulate contaminants.

Any traces of oils and tars which may be formed within the process are treated at high temperature to cause thermal cracking and are thereupon converted to gaseous or solid materials which are further reacted to form the desired gas product. At the same time, the improvements of the present process enhance process economy, especially in water usage, in process heat utilization, and in reliability.

Most water is consumed within the process by the chemical reaction: $C + H_2O \longrightarrow CO + H_2$, and is thereby converted to the desired gaseous product. Only small amounts of water are lost as moisture vapor contained in vented nonpolluting gas streams. Makeup process water does not need to be treated, and, in fact, solids-containing and polluted water from other processes may be used.

A high degree of process heat economy is achieved by virtually complete gasification of the carbonaceous portion of the feed. All fines and dusts are recovered within the process and then burned within the process in oxygen to generate the heat needed for gasification and for process steam generation. Process steam is generated internally with no heat transfer surfaces interposed between the source of heat and the vaporizing water, thereby avoiding most of the inefficiencies which are associated with steam generation in conventional boilers.

High temperature sensible heat is supplied for coal gasification; intermediate level sensible heat and latent heat generates high pressure steam for use in other processes; low level sensible heat and latent heat is rejected to the atmosphere by air coolers; therefore, a minimum of water cooling is needed.

Some of the advantages of process water economy and process heat economy are achieved interdependently. Water is used at many locations throughout the process to scrub particulates from gas streams and to cool hot particulates. The resulting slurry contains substantially all the ash from the process plus associated combustible material and dissolved pollutants. After settling, clarified water is recycled for additional scrubbing and cooling duties; the thickened, concentrated slurry is pumped at a controlled rate to the combustion chamber of the process where the combustibles are burned with oxygen to supply process heat; the slurry water is vaporized and superheated for reaction with coal; and the ash is melted to form slag which is easily separated from the process. In this manner, essentially no combustible carbonaceous matter is withdrawn from the process as byproduct or waste, and the process can accept and usefully burn undesirable high-sulfur, high-ash combustibles which are byproducts or wastes from other processes, such as the high-sulfur, high-ash solid wastes of a solvent coal liquefaction process.

The process is economical from a reliability basis because the hot, pressurized parts of the process contain a minimum of moving mechanical equipment, which may be subject to occasional failure. Mechanical equipment is used sparingly throughout the process.

The process is designed especially to assure safe operation. Coal gasification generates highly combustible gases and these gasification reactions can proceed only by combustion of carbon with oxygen. Safe operation requires that the possibility of oxygen mixing with generated gas will not occur even if the process is badly upset or if coal feed flow is interrupted. Design of the present process assures this safety by interposing a substantial fluidized bed of coal char between the oxygen injection zone and the combustible gas.

Another advantage of the present process is its flexibility in using a variety of conventional fuels, combustible wastes, and potential pollutants as a source of heat for gasification of coal. These combustible materials may have high sulfur content, high ash content, high moisture content but still would be useable. Such fuels are injected into the combustion zone where oxidation occurs. Sulfur oxides and nitrogen oxides which may be formed initially are ultimately reduced to hydrogen sulfide and nitrogen gas or ammonia within the process for easy separation and conversion to acceptable forms. Ash is melted and the slag withdrawn from the process with coal ash slag. Associated moisture is vaporized, superheated, and is reacted with coal to form the desired gas product.

In the present process, gasification is performed in a single reactor vessel which is divided into three zones including a fluidized bed gasification zone, a combustion zone and a slag quench zone. The boundary between the gasification and combustion zones is a grid or perforated partition which acts to support the fluidized bed and distribute gas flow to it. The coal particulates in the fluidized bed in the gasification zone comprise a large excess of carbonaceous material. Therefore, above the grid, within the fluidized bed and in the vapor space above the bed, there exists a reducing zone where chemical reactions occur which form hydrogen and carbon monoxide. At the same time, formation of a bed of carbonaceous material is avoided below the grid in order to produce an oxidation zone in which combustion takes place by burning carbonaceous fuel with oxygen forming carbon dioxide, carbon monoxide, and steam. Heat evolved in the exothermic combustion zone, or combustor, is transferred to the fluidized bed zone, or gasifier, as sensible heat in the gas to support the endothermic gasification reactions.

A solid hydrocarbonaceous feed such as coal, char, or coke is passed through a crusher and subdivided into particles which are introduced by a dry solids feeding device to the fluid bed gasification zone. In the gasifier the particulate is maintained as a fluidized bed, a pseudo liquid state of finely divided solids, by upward flowing hot combustion gases and steam from the combustion zone. These gases flow through a perforate material such as a screen, grate, or grid which supports the fluidized bed and which prevents downward solids flow from the gasifier to the combustor. The gases flow at a sufficient velocity to maintain pariticles in the gasification zone in a highly agitated, disperse, fluidized condition while maintaining a pseudo liquid level at the top of the particles. Essentially no solid or gaseous flow of material occurs downwardly through the grid so that material and heat flow through the grid is entirely in an upward direction and there is essentially no downflow directly from the gasifier zone to the combustion zone.

The preferred position of the combustion zone is immediately beneath the fluidized bed gasification zone, although the combustor may be positioned beside or even above the gasifier so long as combustor gases are introduced beneath the gasifier grid. Feed to the combustor is comprised primarily of the fine coal or high-ash-content char slurried in water, although liquid or gasous fuels may also be used. The aqueous slurry is pumped into the combustor at a controlled flow rate, is suitably atomized, and the carbonacous content is burned with oxygen. Heat of combustion vaporizes and superheats slurry water, and causes ash and other normally solid inorganic substances contained in the slurry to melt, forming a liquid slag. The slag collects on the surfaces of the combustor and drains by gravity to a slag quench container and is thereby separated from the upward flowing combustor gas.

In the preferred apparatus embodiment of the present process, an upper fluidized bed gasifier, an intermediate combustion zone, and a lower slag quench drum are arranged in a single vertically coaxial reactor arrangement. In this arrangement, the only downward flowing material is molten slag which flows by gravity from the combustion zone to the slag quench drum beneath. Aside from downward flow of molten slag, all other primary flows in the combustor and gasifier are upward, including steam produced in the slag quench pot, the combustion gases and superheated steam produced from water and/or steam charged to the combustion zone, the gasifier gases, and the fine carbon-containing ash and char particulates which are formed within the gasifier as a result of gasification and interparticle impacts occurring within the fluidized bed. Elutriated ash-containing char from the gasifier cyclone is separated from the raw gas outside of the reactor vessel, is scrubbed, cooled, and slurried in water, thickened to a slurry or paste, and pumped or injected as fuel to the combustor by a path outside of the reactor apparatus.

The gasification zone is maintained at as high a temperature as possible in order to achieve the highest reaction rates, but temperatures are avoided that promote excessive agglomeration of fluid bed particles caused by ash in the particles softening, becoming sticky, and thereby aggolmerating with others as a result. Such temperatures vary depending on composition of coal ash, but may be approximately 2000°F. (1093°C.) and higher. If temperatures are below about 1400°F. (760°C.), gasification reaction rates for high carbon conversions are too low for practical purposes. The gasifier temperature range, therefore, is about 1400° to 2000°F. (760° to 1093°C.), and typically may be about 1700°F. (927°C.). The gasifier pressure is in the range of 10 to 500 psi (0.7 to 35 Kg/cm$^2$). The lower limit provides sufficient pressure to cause the raw gas product to flow through simple processing for particulate cleanup without requiring intermediate compression; the higher limit is based entirely on the current commercially demonstrated limit for dry solids injection into a pressurized system and, otherwise, could be substantially greater than 500 psi (35 Kg/cm$^2$). Higher pressures are desirable because they make possible higher flows through a vessel's internal cross-sectional area, and process investment costs are thereby reduced. Typically, a pressure of 450 psi (31.5 Kg/cm$^2$) is desirable. Average residence time of a particle in the fluidized bed depends on the particle composition and size, pressure and temperature, and the composition of the fluidizing gas. Usually temperature is varied to change average residence time which may typically be 20 to 30 minutes. A residence time greater than about 60 minutes is undesirable because unusually large and costly gasifier volumes would be needed. A residence time less than about 5 minutes is undesirable because of difficulty in control of fluid bed level as a result of the minimal carbon capacity of the bed.

Following are the principal chemical reactions which occur within the gasifier fluidized bed:

$$\text{Coal} + \text{heat} \longrightarrow \text{Char} + \text{volatiles (including tars)}$$
$$C + H_2O \longrightarrow CO + H_2$$
$$C + CO_2 \longrightarrow 2CO$$
$$C + 2H_2 \longrightarrow CH_4$$
$$CO + H_2O \longrightarrow CO_2 + H_2$$
$$\text{N (combined)} \longrightarrow NH_3$$
$$\text{O (combined)} \longrightarrow H_2O$$
$$\text{S (combined)} \longrightarrow H_2S$$

All of the above reactions reflect the reducing conditions in the fluidized bed. On occasion, heat liberated in the combustor may not be enough to maintain the desired temperature in the gasifier. Then, a small amount of oxygen will be added to the fluidized bed of the gasifier, causing a part of the combustion to take place in the gasifier. Oxygen consumption in the gasifier will be extremely rapid, with carbon converting to carbon monoxide or carbon dioxide. The gasifier reaction conditions are chosen to yield the greatest amount of carbon monoxide and hydrogen while suppressing the formation of methane.

Any tars and normally liquid oils which evolve during devolatilization of coal, if allowed to flow from the gasifier, would seriously complicate the system installed to cool and clean the raw gas. This potential problem is avoided by providing a gas volume within the gasifier above the fluid bed which permits a gas residence time of a few seconds, at least 10 seconds is enough, during which time the high temperature causes destructive thermal cracking of tars and oils to yield gases and carbon, thereby destroying them.

Because coal feed to the gasifier is maintained in a fluidized condition in the reaction zone, the reactions occur under conditions which benefit from all the advantages known to aris from the use of a fluidized bed reaction zone. These benefits include uniform conditions throughout the reaction zone including uniform reaction temperature, rapid and uniform dispersion of coal feed within the reaction system, rapid and uniform dispersion of fresh combustion gases within the gasification zone, and low pressure drop for gas flow through the fluid bed. Maintenance of uniform conditions in the gasifier is highly important. Local hot spots should be avoided because coal agglomeration may be induced, while cool spots result in rapid reduction in evolution of desired gases. The excellent mixing characteristics of the fluidized bed, which induces greatest contracting of gas and finely divided solid reactants, results in greatest yield of desired gas for the operating conditions employed. A further advantage of the fluid bed is that a reactive carbonaceous mass is established between the combustion zone into which oxygen is injected and the hot, flammable reducing gases produced by the process. Therefore, the hazardous condition of oxygen mixing with raw gas is unlikely in the event of ordinary process upsets or loss of feed.

However, the use of a fluidized bed in most chemical reactions incurs a common disadvantage. This common disadvantage of fluidized beds of other processes arises directly from the aforesaid advantage in that the excellent dispersion accompanying fluidization maintains at a uniform or average condition all sections of the bed so that in any part of the fluid bed, the pseudo-boiling solid particles will tend to be at a common, average, or uniform condition or state chemical reactivity whereby no matter which region of the bed is tapped for removal of solid effluent, except for solids grossly larger in size or greater in weight than average bed solids, the effluent which is removed is at the same condition or state of reactivity as the remaining material. Therefore, when solids are withdrawn from fluid beds in most reaction systems, the solids constitute a predictable array of particles which have been present in the fluid bed for different periods of time, and include a proportion of particles which have been newly introduced to the fluid bed and which have had little opportunity to react or to catalyze reactions. Withdrawal of ash from coal gasifier fluid beds must ordinarily require withdrawal of substantial carbonaceous material and some freshly introduced feed particles which reduces the extent of gasification of carbonaceous matter and decreases process efficiency, or the coal gasifier fluid bed must be operated in the ash-rich state, wherein the major constituent of the fluid bed is ash and the minor constituent is carbonaceous, whereupon operation of the fluid bed becomes inefficient because of lessened opportunity for reaction of carbonaceous matter with the fluidizing gas. The present invention avoids these fluid bed disadvantages.

The fluidized bed gasifier of the present invention differs from the fluidized beds utilized in most chemical reactions in which the particles being fluidized are solid catalyst which is in a uniform state of activity throughout the fluidized bed. The fluidized catalyst particles are not a reactant and, therefore, do not diminish in size due to material loss via reaction, although they do change in activity with age due to such occurrences as deposition of deactivating impurities, such as coke. In contrast, the fluidized char particles in the present process do diminish in size since most of their carbonaceous content undergoes gasification. Most of the coal feed particles swell and become puffy upon being heated to gasifier temperature and, furthermore, as gasification progresses the particles undergo substantial loss of mass as material is converted to gas. A fragile particle structure develops as a result of these effects and the fragile structure tends to break into smaller fragments because of inter-particle impacts. The very fine, low density, high-ash-content particles become sufficiently light to be swept out of the fluidized bed by upflowing gases, thereby causing the bulk of the ash content of the feed material to be removed by entrainment in the gas stream flowing from the fluid bed and avoiding the need to withdraw ash by withdrawing average solids from the fluid bed.

Therefore, while the fluidized catalytic solid material in most chemical reactions is removed from the bed at the same level of activity as the average solid catalyst remaining in the bed, in the present process the fluidized solids removed from the bed advantageously have a lower carbonaceous content and a lower carbon-to-ash weight ratio than the average solid material remaining in the bed. In order that the fluid bed of this process function in this advantageous manner, it is important that ash from the fluid bed be removed substantially entirely overhead entrained in the gas stream passing through a gas-solids separator associated with an enclosed gasifier zone and that there be no solids flow downward through the grid from the gasifier zone to the combustor zone nor any substantial solids flow from the gasifier zone to a location external to the reactor vessel other than through an overhead space above the level of the fluid bed. It is noted that all the conventional advantages of a fluidized bed can be obtained by practicing the present process with some solids flow downwardly from the gasifier zone directly to the combustion zone, but if such flow is avoided entirely the additional novel advantage described above is compounded with the conventional advantages otherwise obtainable.

In accordance with this invention, feed coal is crushed in a grinder preferably to a size of less than about one-fourth inch (0.64 cm), although a size of less than one-half inch (1.27 cm) or even 1 inch (2.54 cm) will be satisfactory as long as the particle size range entering the gasifier will be fluidized at the velocity of the fluidizing gas. Very small fines of approximately 60 to 100 mesh size (U.S. screen size) and smaller which are contained in the coal feed or are formed during crushing are elutriated from the crushed product with gas so that the coal particles which are charged to the gasifier are generally free of fines so small that, if introduced to the gasifier, they would immediately be blown out of the fluid bed. Thereby only those coal feed particles which are capable of experiencing an extended residence time within the fluidized bed are charged to the gasifier. By keeping fines in the feed coal out of the gasifier, an unnecessary solids-removal load is shifted from the costly high pressure gasifier solids-removal system. The elutriated fines from the feed coal are recovered from the gas stream by cyclones and by washing with recycled condensate of this process to form a slurry which may be blended with high-ash char slurry from the raw gas stream for eventual feeding to the combustion zone as fuel. By utilizing recycled condensate in cleaning elutriating gas which is used in controlling the particle size range of crushed feed coal, the gasifier feed coal can be classified without expensive mechanical equipment and without pollution of air. Alternative mechanical equipment for controlling particle size range might constitute a massive system of vibrating screens.

The velocity of gas flow through the gasifier bed must be sufficiently great to cause the particles to fluidize, that is to become agitated and disperse so that the mass of particles reaches a physical state similar to a liquid in maintaining a clearly defined surface, in the surface seeking a common and equal level, in appearing to boil, and in accepting higher rates of gas flow without appreciable change in unit pressure drop. However, the velocity of gas flow must not become excessive or unusually large amounts of particles will be elutriated from the fluid bed, in the extreme, the entire fluid bed will disappear, having been carried away in the gas flow. In the present process, a distinct pseudo-liquid level is maintained in the gasifier and is thereby sharply distinguished from an entrained solids flow coal gasification process. The limits of gas velocity are generally in the range of 0.1 foot per second to 5 feet per second (3.1 to 152.5 cm/sec) and preferably in the range of 0.3 to 1.2 feet per second (9.2 to 36.6 cm/sec).

As coal particles enter the gasifier and become heated to reaction temperature, the particles swell up and become puffy, and, as the particles progressively react, they lose weight and density and eventually disintegrate. Until this occurs the particles do not become sufficiently low in weight to be elutriated from the fluid bed. It is an obvious advantage to maintain within the gasifier bed particles having a relatively high carbon-to-ash weight ratio and to only remove the bed those particles which have a relatively low carbon-to-ash weight ratio, i.e., which are approaching the status of ash. In order that only particles having lower carbon-to-ash weight ratio than the average of the fluid bed are removed from the gasifier, it is important to this invention that substantially the only path for char removal from the bed is overhead and that the char is not dropped by gravity directly from the gasifier bed to the combustor. In this way the fluid bed encourages the gasification reaction to proceed to the fullest extent and at the same time an uncontrolled flow of fuel is denied to the combustor.

The gasifier may be designed with an enlarged diameter above the fluidized bed zone which, by reducing the velocity of gas flow, permits some larger elutriated particles to drop back into the fluid bed. First stage cyclones are mounted in or near the gasifier vapor space and vapor discharge from the gasifier must flow through the cyclones in which additional elutriated particles are separated from the gas and returned to the fluid bed. Only fine solids are carried in the gas stream from the first stage cyclones and these are removed by additional cyclones and by recycle condensate washing of the gas, so that the finest solids are recovered in an aqueous slurry which, after various steps external to the reactor, is eventually injected into the combustor as fuel to supply the heat needed in the gasification process.

In order to efficiently carry out the present process of gasification with substantially all of the ash contained in the feed being carried out of the fluid bed in the gas flow and substantially none of the carbonaceous solids being removed directly from the fluid bed, the opportunity for large agglomerates to form in the fluid bed and disrupt the process and the operation of the fluid bed should be minimized. Two types of agglomeration may occur: in one, as a result of high temperatures in the fluid bed, ash in the particles may become sticky, causing particles to cling together; in the other the carbonaceous substance of bituminous coal particles, upon being heated to gasifier reaction temperature, softens, becomes sticky, and clings to particles and surfaces that are contacted. As a result, the present process utilizes non-agglomerating carbonaceous feeds including lignite, sub-bituminous coal, anthracite, petroleum coke, and various organic waste materials. Bituminous coals may be used after pretreatment to render them non-agglomerating. Such pretreatment involves mild oxidation of the surfaces of bituminous coal particles by air at about 750° to 800°F. (399° to 427°C.) and is a process known to those skilled in the art of coal gasification.

Although formation of agglomerates is strictly limited by controlling feed composition and by careful limitation of maximum gasifier temperature, some agglomerates may form in the fluid bed and these must not accumulate in an uncontrolled manner. Agglomerates, being heavier and of larger size than the fluidized bed particles, concentrate at the bottom of the bed on the grid. As a result of the grid design, the agglomerates flow to a limited zone on the grid from which they, in mixture with normal fluid bed particles, are drawn to a classifier. A recycled stream of raw gas elutriates normal fluid bed particles from the agglomerates and the elutriated solids are returned to the gasifier. The agglomerates can be crushed and returned to the gasifier or may be removed from the process for external treatment or disposal. Agglomerates are not charged to the combustor as fuel without having been first crushed and slurried in water.

The combustor generates heat to support the endothermic gasification reactions in the gasifier and heat to vaporize and superheat water for reaction in the gasifier. The amount of water vaporized and superheated in the combustor is in excess over that which is reacted in the gasifier because the desired gasifier reactions are encouraged by an excess of water reactant. The heat is evolved by combustion with oxygen of carbonaceous matter, which is introduced to the combustor as a slurry in water. At the same time, ash or normally solid inorganic substances contained in the combustor feed are melted, forming a slag, which is readily separated from the gaseous product and, after resolidification, is withdrawn from the reactor system. The primary carbonaceous fuels for the combustor of the present process are coal fines generated during crushing of feed coal; high-ash-content fine char elutriated from the fluidized bed of the gasifier; and fuels provided from outside of the process which may be high-sulfur-content, high-ash, and wet with moisture or organic solvents, and can advantageously be the high-sulfur, high-ash insolubles of a coal solvent liquefaction process. High sulfur petroleum coke from an oil refinery can comprise another fuel derived from outside the process.

Since fuel is charged to the combustor in slurry with water, rather than as a dry solid, the combustor fuel injection rate is easily controllable and combustor fuel is easily injected against system pressure. Furthermore, the water content of the slurry is vaporized in the combustor, superheated, and becomes a means of heat transfer from the combustor to the gasifier and also becomes a reactant within the gasifier, thereby avoiding the need for an external boiler to generate process steam for use in the gasifier. If the fuel were injected as a dry solid, an expensive lockhopper system, or equivalent, would be required to preserve system pressure during injection, and a virtually constant flow of combustible would not be assured. Even if fuel were recovered for dry solid injection, because of the high ash content and high temperature of dry fines, they cannot be passed through valves and pressure regulating equipment without severe erosion occurring, and handling and cooling of hot, dry fines require elaborate facilities. In accordance with this invention, cyclones are used for recovery of most of the hot fines which, upon recovery, are cooled and slurried in water. In addition, the gas stream is further cleaned of particulates by water scrubbing. Most of the water employed in scrubbing is the excess steam reactant from the gasifier which after condensation is available for scrubbing the stream from which it is condensed. These recovered solids, after thickening, are pumped as slurry for fuel to the combustor. In addition to the improved gas cleaning which results, it is more economical to store char destined for use as combustor fuel as an aqueous slurry than as a hot, low density (high volume per unit weight) solid.

The combustor temperature must be greater than the temperature of the gasifier to which it supplies reactant gas and sensible heat. The greatest combustor temperature is limited by the temperature limitation of the internal insulation of the vessel which may be well above 3000°F. (1649°C.). The normal combustor temperature will be that which yields a slag of low viscosity which will drain readily from combustor walls. This temperature will vary depending on ash composition and whether additives are used to modify the ash melting temperature and its viscosity. Normal temperature range will be 2400°F. (1316°C.) to 3300°F. (1816°C.) with 2700°F. (1482°C.) being a typical temperature. The combustor pressure will be established by the pressure of the gasifier because the two parts of the reactor vessel are separated only by a grid. Average residence time of a particle in the combustor will depend on particle composition and size, pressure and temperature, and effectiveness of contacting with the oxidizing gas. Normal residence time in the combustor will be a few tenths of a second, and in no event is a time greater than 30 seconds needed.

The primary chemical reactions occurring in the combustor are:

$2C + O_2 \longrightarrow 2CO$ $C + O_2 \longrightarrow CO_2$ $CO + H_2O \longrightarrow CO_2 + H_2$ N (combined) $\longrightarrow N_2$ and $NO_2$ and $NH_3$ O (combined) $\longrightarrow H_2O$ S (combined) $\longrightarrow SO_2$ and S These reactions reflect the oxidizing conditions in the combustor as contrasted to the reducing conditions in the fluidized bed. In addition to the above chemical reactions, pollutants contained in the slurry water such as phenols, cyanides and other nitrogenous substances, and various sulfur compounds are destroyed in the combustor as a result of combustion with oxygen and exposure to very high temperatures. The combustor conditions are chosen to generate a maximum of useful heat for the gasifier while avoiding vaporization of excessive amounts of water. As a result, combustor conditions may be chosen ranging from virtually total combustion of carbon to carbon dioxide to combustion primarily to carbon monoxide with a much reduced yield of carbon dioxide.

In the combustion zone, sulfur compounds contained in the fuel or in the slurry water are burned to sulfur dioxide. However, all gases produced in the combustion zone flow into the gasifier which is at reducing conditions. Therefore, in the gasifier the sulfur dioxide is advantageously reduced to hydrogen sulfide which, unlike sulfur dioxide, is a form of sulfur which can be efficiently and completely scrubbed from the product gas stream by a variety of established commercial methods. Some load will be removed from the product sulfur scrubber by recycle of some hydrogen sulfide dissolved in water recycle to the combustor because some of the recycled sulfur will become oxidized and react with ash components to form metal sulfates and be removed as molten slag from the combustor rather than returning to the product gas stream.

Combustor fuel is a thickened aqueous slurry of coal fines and high-ash fines from gasification which is stored in tanks containing mixing devices. The slurry may normally range between 30 percent and 50 percent solids content and typically may be between 40 percent and 45 percent solids by weight. The solids concentration in the slurry can be controlled to provide constant heat and water values in the combustor feed. However, slurry may also constitute an aqueous paste of up to 70 percent solids which is pumpable or extrudable in a controlled manner to the combustor. Any high sulfur ash-containing coal residue and any aqueous combustible contaminants or dissolved salts charged to the water storage system from external processes will also be present in the slurry, and the slag and combustion gases from these external materials will be mixed with the slag and combustion gases otherwise generated in the combustion zone. The slurry is pumped into the pressurized combustion zone while easily controlling the rate of flow and thereby accurately controlling the amount of heat release within the combustor. The slurry is sprayed, atomized, or otherwise broken up into fine particles upon entering the combustor through a plurality of nozzles such as one or more pairs of opposing nozzles. Oxygen is separately injected into the combustor and its rate may be controlled to yield a slight excess of oxygen or a deficiency of oxygen for complete combustion. As a result of heat evolved by combustion of carbonaceous matter in the feed with oxygen, slurry water is evaporated, superheated, and flows to the gasifier as a reactant, while melted ash flows by gravity to a slag quench drum.

Much of the slag formed in the combustor collects on the combustor walls and drains into a water filled slag quench chamber and is thereby solidified while much of the heat contained in the slag vaporizes water forming stream which rises into the combustion chamber.

Cooled solidified slag is removed from the slag quench drum through a crusher or other device which insures that large sizes of particles will not pass to interfere with external operation of pumps or valves. The solidified slag is removed from the pressurized system through one or more water filled lockhoppers. At near atmospheric pressure, the solidified slag in water slurry is dewatered by thickeners, filters, or similar dewatering devices, and is transferred to disposal or to other processes for recovery of valuable metals, while the recovered slurry water is returned to the process.

Part of the slag in the combustor forms tiny molten particles which are carried in the flow of the combustor gas. These molten particles are solidified in the upper section of the combustor by injection of water or of recycled carbon dioxide, which causes the combustor outlet gas temperature to be below the solidification temperature of the slag. In this way the combustor gases are cooled and prevented from entering the gasifier to prevent slag accumulation and plugging on the grid while the total heat content of the gas is not materially changed. The quenching water or carbon dioxide are heated to a temperature to serve as heat carriers to the gasifier and reactants in the gasifier. Quenching temperature will depend on the composition of the slag but will be in the range of 1900°F. to 2300°F. (1037°C. to 1260°C.) and typically about 2000°F. to 2100°F. (1093°C. to 1149°C.). Any resolidified slag which does enter the gasifier fluid bed is carried out of the bed in the raw gas, is recovered outside of the reactor system, and is recycled to the combustor for rejection through the slag quench chamber.

Because excess water reactant is condensed and reused extensively in the present process and because little or no process water is lost or withdrawn from the process, and because water as steam is continually being converted into the gaseous products of hydrogen and carbon monoxide by the process, there is a need for a continuous stream of makeup water for the process. Water purification by vaporization in the combustor operation which is, in effect, a process of generating steam from water laden with solids and the method for rejection of normally solid noncombustible substances from the process permit raw untreated water or foul polluted water from other processes to be introduced into the water slurry system of the present process to obviate water purification procedures otherwise attendant to disposal of water from such other processes. For example, high solids content water such as boiler blowdown or cooling tower blowdown water can be used as makeup to the slurry system of the present process. Such water contains dissolved or dispersed salts which are conveniently disposed of in the combustor by slagging with the coal ash. Addition of such salts to the combustor feed can cause the feed to contain a higher ratio of slaggable material to carbon than the ratio in the coal feed to the gasifier or in the gasifier char.

Similarly, a combustible solid material (or gaseous or liquid) which is otherwise not useful as fuel because of the polluting character of its combustion gas can be utilized as combustor fuel. An example is the high-sulfur carbonaceous residue (perhaps containing diatomaceous earth filter aid) from a coal solvent liquefaction process. This residue can be added to the slurry system of the present process or can be charged directly to the combustor. Ordinarily, such a residue contains so much sulfur that it cannot be burned without an unacceptably high sulfur dioxide emission. When burned in the present process, the sulfur dioxide produced, which is very difficult or impossible to treat in a commercial manner, is converted to hydrogen sulfide in the gasifier and can then be easily recovered by known processes as elemental sulfur without the possibility of pollution. Thereby, the heat content of the high sulfur coal residue of a coal liquefaction process is recovered without emission of sulfur oxides to the atmosphere. Ash and diatomaceous earth contained with the high sulfur coal residue is slagged with the ash from the present process, resulting in facile disposal of ash and diatomaceous earth and sulfur while usefully recovering the heat content of an otherwise unuseable coal residue. At the same time, the gases generated by the present process as a mixture of carbon monoxide and hydrogen or after conversion to hydrogen may be used to supply the hydrogen requirements of the coal liquefaction process from which the high sulfur coal residue was recovered.

To obtain high reaction rates and rapid conversion of coal in the gasifier, it is necessary to have present an excess of steam reactant compared to the amount of steam required stoichiometrically for reaction with coal in the gasifier. This excess steam is condensed from the raw gas product, producing a condensate contaminated with fine solids and by other substances dissolved from the gas. From most processes this foul condensate would require expensive purification to render it fit for discharge into a public waterway. However, it is an important feature of the present process that this condensate is not discharged beyond the battery limits of the process but is utilized to scrub various gas streams within the process, to cool and to remove solids and normally gaseous and liquid atmospheric pollutants from said streams, and then is consumed altogether with much of the scrubbed impurities within the process.

The polluted steam condensate recovered from the raw gas product is first cooled and recycled to recontract the raw gas product stream from which it is condensed to cool and to scrub particulates from the raw gas. This recycling procedure essentially renders the raw gas stream self-purifying. The condensate scrubbing of the raw gas product stream is performed in advance of acid gas removal processes, or compression, thereby removing materials that could contaminate or erode systems. The recycled condensate which contains slurried char particles scrubbed from the gas as well as normally liquid and gaseous atmospheric pollutants is passed to a solids settler which may also serve as a reservoir or surge tank. A centrifuge or any other device for concentrating solids can be used in place of a settler, although a settler is preferred. Clarified water from the settler is recycled to various process streams to scrub fines and pollutants from these streams and is then returned to the settler or charged into a holding tank. The concentrated solids slurry from the settler is pumped into the combustor at a rate which is easily controllable. In the combustor, many of the contaminants contained in the raw gases which were transferred into the slurry water are destroyed by combustion. In this manner, potential atmospheric pollutants while being destroyed contribute their heat of combustion to the process.

Recycled condensate is also used to cool and slurry hot, dry particulates which are recovered by cyclones so that these particulates can be handled and transferred readily at moderate temperature without elaborate equipment.

Therefore, water is recycled within the process in a manner that makeup water requirement is reduced, outflow of contaminated water is reduced or eliminated, waste water treating facilities are substantially reduced in size or entirely eliminated, and pollutants are destroyed while their heats of combustion are salvaged.

The feeding of coal fines to the combustor in the form of an aqueous slurry in recycle foul steam condensate and injecting all of the fines from the feed crushing step and the high-ash char from the gasification reactions provides the advantages of (1) eliminating the fines and char, (2) vaporizing foul process water to provide steam required for coal gasification, (3) supplying the heat required for the gasification reactions occurring in the gasifier fluid bed, (4) causing ash to form slag which is readily removed from the system by gravity flow, (5) destroying pollutants removed from the raw gas stream by recycled scrub water, (6) obviating the need for expensive waste water purification apparatus. (7) reducing the requirement for fresh water in the process, and (8) providing an economic system for utilizing polluted water, high sulfur content combustibles, and slaggable solid wastes from other processes.

The invention will be more completely understood by reference to the accompanying drawing. As shown in the drawing, non-agglomerating carbonaceous materials such as sub-bituminous coal, lignite, anthracite, char, petroleum coke, or other carbonaceous substance enters the process through line 10 and is subdivided to a particle size of preferably about one-fourth inch (0.64 cm) and finer in grinder 12. The maximum particle size may be one-half inch or one inch (1.27 or 2.54 cm) or even larger as long as the largest particles have no pronounced tendency to settle and separate from other particles in the gasifier's fluidized bed. Bituminous coal has the property of agglomeration at the conditions encountered in the gasifier and, therefore, is not suitable as a feed without prior treatment. Agglomeration is caused by temperature and hydrogen atmosphere in the gasifier and refers to the condition of softening of particle surfaces and the sticking of one particle to another. Serious operational problems might occur as a result of formation of massive agglomerates, such as, attachment of large masses of agglomerates to vessel walls, interfering with desired flow patterns, and attachment to and pluggage of gas distribution grids. Agglomeration of bituminous coal can be prevented by pretreatment, a process in which the surface of the coal particles is oxidized under moderate conditions. Pretreatment to prevent agglomeration of coal particles is well known to those knowledgeable in the art of coal gasification. Following pretreatment, the treated bituminous coal particles, known as coal char, are suitable as feed for the process of this invention.

Crushed coal flows from grinder 12 through conduit 14, from which it is caught up by an elutriating gas stream entering through line 16. The entrained coal flows through conduit 18 to vessel 20 in which the larger particle sizes settle as a result of the decreased velocity of the gas. Preferably, most of the finer particles, of about 100 mesh particle size and finer, are elutriated from the coarser particles and continue in upward flow with the gas through overhead line 22. Coarse coal particles drop to the bottom of settler 20 for passage through bottom outlet line 24 and valve 26 to feed lockhopper 28. In this manner, fine particles are removed which, if contained in the gasifier feed, would be quickly elutriated from the gasifier fluid bed, requiring substantially increased gas-solids separating equipment in the costly high pressure-high temperature system. Separation of fine from coarse particles could also be performed by recourse to a massive system of vibrating sieves or screens but such apparatus is unwiedly and costly.

Coal enters the pressurized gasifier system by means of feed lockhopper 28 through manipulation of valves 26 and 30. When feed lockhopper 28 is filling, valve 26 is open and valve 30 is closed, and when feed lockhopper 28 is emptying, valve 26 is closed and valve 30 is opened, thereby preventing loss of gasifier pressure. For crushed coal to be continuously supplied to the gasifier, one or more additional feed lockhoppers, not shown are arranged in parallel with lockhopper 28.

Crushed coal, primarily of size ranging from about 100 mesh to about one-fourth inch (0.63 cm), flows from feed lockhopper 28 through line 32 to gasifier 34. Gasifier 34 contains a fluidized bed 38 of disperse coal particles which reacts with hot combustion gas and steam rising through grid 168 from combustor 156. The chemical reactions of coal gasification take place at conditions preferably ranging from 1400° to 2000°F. (760°to 1093°C) temperature and 10 to 500 psi (0.7 to 35 Kg/cm$^2$) pressure. Average particle residence time will vary markedly depending on its chemical constitution, its initial size, the actual temperature and the composition of reacting gas from the combustor, but approximately 30 minutes will be typical.

The choice of reaction conditions is briefly described as follows: At temperatures lower than the preferred minimum, reaction rates are too low and formation of methane is enhanced, which is not desired. At temperatures above the preferred maximum, ash contained in the particles softens, causing agglomeration problems. The minimum pressure chosen is necessary to force the flow of gas through downstream equipment without the need for intermediate compression. The maximum pressure is established on the basis of reliable operation of lockhopper valves and is about the greatest pressure at which lockhopper valves have operated satisfactorily on a commercial basis until this time. The indicated typical residence time is adequate to avoid serious complications which might otherwise result from short-term feed system malfunction, and represents a safety factor by providing ample capacity of carbonaceous substance under reducing conditions to safely separate the oxidizing combustor zone into which oxygen is injected, from the reducing raw gas system.

The gasifier fluidized bed 38 has an upper pseudoliquid surface or interface 40. Some particles, in general smaller than average size, are entrained by rising gas into the space above interface 40. The larger vessel diameter zone 44 causes a reduced velocity of gas flow, permitting some of the entrained particles to drop back into the fluid bed 38. Gasifier effluent passes through first stage cyclone 46 which induces separation of additional solids from the gas. The separated solids are returned through leg 48 to the interior of fluid bed 38. One or more first stage cyclones 46 may be required in the top space of the gasifier 34. Gas effluent from first stage cyclones 46 passes out of the gasifier through line 50 to one or more second stage cyclones 52. Additional char fines are removed in cyclone 52 and these fines pass through dip-leg 54 to fines quench chamber 56. Only a small amount of the smallest sizes of fines are contained in the gas passing from the second stage cyclones 52.

In the gasifier 34 small amounts of tar vapors may be evolved from the coal feed as a result of the high temperatures. Condensation of tar vapors in the gas handling parts of the process could cause fouling, pluggages, and substantially interfere with downstream gas treating and downstream handling of condensed water streams. This is prevented by designing the volume of the gasifier 34 which is above the fluid bed interface 40 so that residence time of gases will be approximately 10 to 20 seconds. As a result of time and temperature in zone 44 any tars and other potential hydrocarbonaceous liquids are thermally cracked to gases and carbon, thereby avoiding a serious problem with which some gasification processes must deal.

Even though care is used in choice of feed to the gasifier, some agglomerating constituents may be included in the feed inadvertently or some ash agglomerates may form in the fluid bed as a result of local, short-term deviations from normal operating conditions. If formed, agglomerates are purged from the fluid bed as follows, taking advantage of the property of large particles to segregate at the bottom of the fluid bed. Grate 168 is shaped in the form of an inverted dish for structural strength and to collect any non-fluidized ash agglomerates formed in gasifier 34 and to aid in their concentration and discharge out of gasifier 34. Agglomerates flow through line 190 to classifier 192. A pressurized recycle stream of raw gas taken from line 92 is passed through line 194 to elutriate any fines from agglomerates, and to transport fines separated in the classifier 192 back to the gasifier through line 196. Large agglomerates, free of fines, pass through line 198 to lockhoppers 200 and 202 provided with valves 204, 206 and 208, for maintaining gasifier pressure when withdrawing solids. The hot agglomerates are quenched in lockhoppers 200 and 202 by immersion in water. The resulting agglomerate slurry is removed from the system through line 210 for further processing or disposition, while recycle water is added to lockhopper 200 through line 212.

Except for removal of agglomerates through line 190, the removal of ash from gasifier 34 is entirely overhead as finely divided solids entrained in the raw gas. There is no flow of solids or gases downwardly through grate 168. Feed coal particles remain in the gasifier until their carbonaceous content is mostly gasified. Swelling of feed particles due to heat and removal of carbon by gasification creates a fragile particle structure of high ash content which breaks up into fine, low-bulk-density particles as a result of inter-particle contacting in the fluid bed. The fine, high-ash-content particles are carried from the gasification zone by the flow of gases and are separated from the gases outside of the gasifier mainly in the second stage cyclone 52 but also in the venturi scrubber 68 and in the water wash tower 74. The heating value of these particles is recovered by injecting them as fuel into the combustor 156 and thereby supplying part of the heat needed for gasification. In the combustor 156 the ash contained in the particles is melted and withdrawn from the system as slag through lower throat 164.

All of the coarser particles are removed by passage of the raw gas through first stage cyclones 46 and second stage cyclones 52. The high temperature of the gas is reduced and the sensible heat content recovered by heat exchange of the gas with boiler feed water in steam generator 60. Boiler feed water enters the steam generator 60 through line 62 and is converted into process steam which exits through line 64. The steam may be used in the present process, in a different process, for electrical power generation, or for heating as desired. Cooled raw gas flowing in line 66 contains as major gaseous constituents carbon monoxide, hydrogen, carbon dioxide, and water vapor, and as minor constituents ammonia, hydrogen sulfide, methane, cyanides, carbonyl sulfide and possibly, traces of phenols and chlorides.

Furthermore, the raw gas also contains some veryfine particulates. To prepare the gas for further treatment it is desirable to cool and condense most of the water vapor and to remove essentially all remaining dust from the gas. The gas in line 66 passes through venturi scrubber 68 where it is scrubbed utilizing condensed reactant steam and recycle water entering through line 70. The mixture of gas, liquid, and particulates formed in venturi scrubber 68 passes through line 72 to water wash tower 74 which is equipped with baffle plates 76. In water wash tower 74 the gas is further scrubbed with water which enters through line 86. Raw gas, free of particulates, is removed from the system through line 92. Subsequent processing of the gas can be performed by a variety of well-known methods, depending on the desired ultimate use of the gas. The gas may be scrubbed for removal of carbon dioxide, hydrogen sulfide, and ammonia using well-known commercial processes. The cleaned gas may be used as medium-heat-content fuel gas, as a reducing gas, or may serve as feed for processing into a hydrogen-rich stream for use in chemical processing, petroleum refineries, steel mills, and coal liquefaction and gasification (for high Btu gas) processes.

Water from line 70 injected into the venturi scrubber 68 cools and condenses water vapor entering the scrubber through line 66, in addition to removing fine particulates from the gas. Water separates from the gas in the base of the water wash tower 74 and a reservoir of water 78 is maintained in the tower. This water contains fine particulates which have been scrubbed from the gas, and water soluble gas components such as ammonia, part of the hydrogen sulfide and carbon dioxide, cyanides, chlorides, and dissolved fixed gases. The water is transferred from the bottom of the wash tower 74 by pump 80 through line 82. A portion of the flow in line 82 enters line 84 and is cooled by air cooler 85 before flowing through line 86 as wash liquor for water wash tower 74 and through line 88 to venturi scrubber 68. Recycle water is added through line 90.

The remainder of the aqueous stream in line 82 passes through air cooler 92 and line 94 into slurry thickener 96. As a substitute for or together with fresh makeup water, contaminated water or solids-containing water from an external process, such as boiler or cooling tower blow-down water containing slaggable salts, or difficult to treat waste water such as water containing combustible pollutants such as phenols or cyanides, can be charged to thickener 96 through line 97 as makeup water. For example, an aqueous slurry of waste from a coal liquefaction process, a mixture containing diatomaceous earth used as filter aid, ash, and high sulfur undissolved coal residue from a coal liquefaction process, can be passed through line 97 for use within the present process. The ash contained in any residues from an external process is conveniently slagged with the ash from the coal charged to the present process. In this manner, the present process can supply hydrogen-rich gas to and receive waste from an associated coal liquefaction process.

The purpose of the thickener is to produce a clarified, low-solids-content water for recycle within this process for scrubbing, cooling, and quenching of various streams and to produce a thickened slurry of relatively constant content of combustible material. Any other aqueous clarifying means can be utilized in place of thickener 96, such as a centrifuge or rotary filter. Clarified water flows over weir 98 of thickener 96 to trough 100, from which pump 102 discharges it through line 104 to supply the process recycle water system. Recycle water is used in the following locations: enters wash tower 132 through line 146, lockhopper 200 through 212, suction of pump 184 through line 188, combustor 156 through line 160, fines quench 56 through line 122, and venturi scrubber 68 through line 90. Thickened slurry concentrates in the lower portion of thickener 96 and flows through line 106 to pump 108 and is discharged into line 110 and into slurry tank 112 which is equipped with stirrer 114. Slurry tank 112 also receives makeup of slurry from fines quench 56 and coal fines slurry tank 136. These streams may also be routed through thickener 96, if desired. The slurry tank 112 contains the supply of feed slurry which, for best operation, can be adjusted for constant heating value and water content for combustor 156.

Particulates separated by second stage cyclones 52 flow through dip-leg 54 and by flapper valve 118 to fines quench tank 56. Fines entering the quench tank 56 are quenched by an aqueous spray entering from line 120. The water slurry of fines 126 collects in the bottom of the fines quench tank 56. This water slurry 126 is recycled by pump 128 into line 120 from which it sprays onto and forms a slurry with particulates, or the slurry 126 is transferred to either slurry tank 112 or to thickener 96. Makeup water to the fines quench tank system may enter as recycle water through line 122 or as non-clarified process water from water wash tower 74 through line 124.

Elutriated coal fines from coarse coal settler 20 flow in line 22 to cyclone separator 128 which removes most of the largest particle sizes. Gas carrying the smallest fines discharges from cyclone 128 through line 130 to wash tower 132. Water enters wash tower 132 through line 144 from coal fines slurry tank 136 and as clarified recycle water through line 146. The water scrubs the remaining fine particles from the entering gas which vents from wash tower 132 through line 148, essentially free of particles. Wash water containing fines scrubbed from the gas flows through line 135 into coal fines slurry tank 136. Also entering the coal fines slurry tank 136 are solids separated from the gas by cyclone 128 through dip-leg 134. These solids are also slurried in the tank 136. Water slurry from tank 136 is recycled by pump 138 through lines 140 and 144 for additional gas scrubbing. Pump 138 transfers excess slurry through lines 140 and 142 to the gasifier fines slurry tank 112 or to thickener 96.

Combustor fuel which is stored in slurry tank 112 as an aqueous slurry 116 is made up from the following sources: coal fines which are formed during grinding of coal feed from coal fines slurry tank 136, and fine high-ash particulates separated from the raw gas stream and transferred from fines quench 56 and water wash tower 74. In addition, solids from an external process may be introduced through line 97. Practically all of the ash content of raw coal feed plus associated carbonaceous matter is recovered as part of combustor fuel. These fines are not suitable for gasification because of their small size and high ash content. The heating value contained in the fines is usefully recovered in the combustor when burned with oxygen to create the heat needed for gasification of the coarser particles and the heat to generate the steam needed for the gasification reactions. So that the combustor will operate reliably with controlled heat release, slurry 116 carbonaceous solids content is controlled as is water content of the slurry by operation of thickener 96 and by operation of coal grinder 12 for production of greater or lessor amounts of coal fines.

The purpose of combustor 156 is to burn fuel to generate the necessary heat for coal gasification and to generate the steam needed for gasification. An additional purpose of combustor 156 is to cause all normally solid ash constituents of the combustor feed to be melted into slag and thereby to be readily separated from the system in a form which is oxidized, of low sulfur content, and stable for environmentally acceptable disposition as land fill or other purposes. An additional purpose of the combustor 156 is to cause the oxidation and destruction of water soluble pollutants such as phenols, cyanides, sulfur compounds, and ammonia contained in process water streams from this process and from external temperatures thereby enormously reducing waste water treatment requirements of this and associated processes and providing the means that stringent environmental regulations may be readily met.

Combustor 156 is a high-temperature, exothermic, reaction zone which is maintained at temperature greater than about 2200°F. (1204°C.) and, in any case, high enough tha ash contained in the feed is melted into slag, which temperature may be most often between 2400°F. (1316°C.) and 2900°F. (1593°C.). Certainly, combustor temperature must exceed the prevailing temperature in gasifier bed 38 because the combustor supplies heat for the endothermic reactions occurring in gasifier bed 38. Combustor 156 pressure is virtually the same as the pressure of the fluidized bed gasifier 36.

An aqueous mixture 116 as a slurry or paste is pumped or injected from slurry tank 112 by pump 150 through lines 152 and 154 into pairs of opposing burners mounted in combustor 156. Slurry water is flashed into steam by radiation from the hot flames and refractory walls of the combustor. Oxygen enters combustor 156 through lines 158 and oxidizes the carbonaceous portion of the fuel in tenths of a second. The high temperature causes ash to melt into slag which collects on combustor walls and flows by gravity to the slag discharge throat 164. Part of the slag forms into tiny molten particles which are swept upward by the combustor gas flow. These entrained molten particles are solidified by injection of quench water sprayed through line 160 into the upper throat of the combustor, causing a moderate reduction in gas temperature. Solidification of entrained slag particles is essential to avoid coating and pluggage of grid 168 and the cool parts of the gasifier. Normally, heat evolved in combustor 156 and contained in combustor gases is adequate to sustain gasifier 34 temperature at the desired level. However, for improved temperature control in the gasifier, additional oxygen may be introduced through line 218 into the gasifier for oxidation within the gasifier fluid bed 38.

Flux can be added to combustor feed slurry in slurry tank 112, by means not shown, if required to raise or lower the slagging temperature of ash, salts, metals, diatomaceous earth, or other material being slagged in combustor 156 so that the combustor temperature can be easily maintained in the desired range.

Perforated grid 168 supports fluidized bed 38 in gasifier 34, distributes gas flow to the bed for satisfactory fluidization, and constitutes a physical boundary between the combustor zone beneath and the reducing zone of the gasifier above. Gas flow is upward through grate 168, and essentially no downward solids flow occurs. The grid 168 is preferably shaped as an inverted dish to concentrate agglomerates that may form in fluidized bed 38 so that they may be readily removed laterally from the system through line 190.

Molten slag formed in combustion zone 156 collects on the vessel walls and runs by gravity through the lower combustor throat 164 and falls into slag quench drum 166. Slag quench drum 166 contains a water quench, which is introduced through line 214, into which the molten slag drops, is cooled, and is solidified. Heat given up by the hot slag causes part of the water quench to vaporize, thereby returning heat to the combustion zone in the form of steam. Cooled, solidified slag in slag quench drum 166 passes through crusher 169 to ensure that large particles of solidified slag will not interfere with the operation of or damage lockhopper valves 216 or pump 176. From crusher 169 cooled slag passes into line 170 and slag slurry lockhoppers 172 and 174. The operation of lockhoppers 172 and 174 serves to retain the elevated pressure in the combustor 156 while withdrawing solidified slag in a water slurry. The slag slurry is transferred by pump 176 to a slag thickener and filter system 178 from which dewatered slag is recovered for disposal through line 180. Clarified water is recycled through line 182, pump 184, and line 186 to slag slurry lockhoppers 172 and 174. Recycle water enters through line 188 to make up for moisture losses due to vaporization or to wetting of slag to disposal 180.

As a result of the cooling, quenching, and solidified slag transferral system, most of the heat contained in the molten slag is returned to the combustion zone as steam. It will also be appreciated that any solids such as ash, salts, or diatomaceous earth introduced to the present process through line 97 from another process such as a coal solvent liquefaction process can be conveniently slagged and disposed of together with ash of coal feed to the present coal gasification process and simultaneously the heating value of any carbonaceous material associated with the ash will be recovered to aid in additional coal gasification.

It will be apparent from the above process description that the description covers the best mode of performing an integrated gasification process and that the invention has been described within the context of the broad battery limits of a fully integrated gasification process. It will further be apparent that within the overall battery limits of the integrated process individual features of the integrated process can be practiced independently of other features, if desired. For example, the improved fluid bed gasifier system as described and the condensate product gas scrubbing system for removing pollutants and burning these pollutants within the process can be practiced independently of each other. The system for elutriating feed coal fines, slurrying these fines and feeding the slurry to the combustor can be practiced independently of the product gas condensate scrubbing step. And all of these systems can be practiced without introducing into the process either contaminated water from another process or high sulfur coal residue from another process, while each of these latter two features can be practiced independently of the other and of the aforementioned systems. Therefore, each of these independent systems and features are claimed as independent inventions in separate patent applications filed on even date herewith.

I claim:

1. A process for gasifying feed ashcontaining solid carbonaceous particulates comprising passing a first feed stream comprising an aqueous mixture of carbonaceous particulates together with an oxygen-containing gas to a combustion zone to provide heat and reactants for said process, passing a second feed stream comprising carbonaceous particulates to a fluidized bed gasifier zone disposed upon grate means with said second feed stream entering said gasifier zone above said grate means, said aqueous mixture comprising at least in part waste water containing at least one member selected from the group consisting of combustible pollutants and slag-forming salts, maintaining said combustion zone under exothermic oxidation reaction conditions including a temperature between 2200° and 3300°F. and a residence time of up to 30 seconds to produce hot combustion gases and steam and to convert ash into molten slag, passing said hot combustion gases and steam upwardly from said combustion zone through said grate means into said fluidized gasifier zone to form a fluidized bed of said second feed stream particulates having a pseudo-liquid level, injecting at least one coolant selected from the group consisting of water and steam into said hot combustion gases between said combustion zone and said grate means to solidify molten slag in said hot combustion gases, maintaining said gasifier zone under endothermic reducing conditions including a temperature between 1400° and 2000°F., an average particle residence time of 5 to 60 minutes, and a pressure of at least 10 psi at which carbon dioxide and water vapor react with carbon to produce carbon monoxide and hydrogen, withdrawing an overhead stream from said gasifier zone comprising carbon monoxide, hydrogen and water vapor, said overhead stream containing elutriated solid particulates from said fluid bed, said elutriated solid particulates having a lower carbon-to-ash weight ratio than the average carbon-to-ash weight ratio of the particles in said fluid bed, said elutriated solid particulates comprising substantially all the fluidized solid particulates removed from said gasifier zone, said process essentially avoiding removal of a stream of average carbon-to-ash weight ratio fluidized solid particulates from said fluid bed.

2. The process of claim 1 wherein said feed solid carbonaceous particulates are selected from the group consisting of coal and coke.

3. The process of claim 1 wherein the ratio of ash to carbon in said first feed stream is higher than in said second feed stream.

4. The process of claim 1 wherein said elutriated solid particulates are fed to said combustion zone.

* * * * *

UNITED STATES PATENT OFFICE

CERTIFICATE OF CORRECTION

PATENT NO. : 3,971,637

DATED : July 27, 1976

INVENTOR(S) : Charles W. Matthews

It is certified that error appears in the above-identified patent and that said Letters Patent are hereby corrected as shown below:

COL. 2, line 47, after the word "by" insert --application of high temperature heat which is supplied by--

Signed and Sealed this

Ninth Day of November 1976

[SEAL]

*Attest:*

RUTH C. MASON
*Attesting Officer*

C. MARSHALL DANN
*Commissioner of Patents and Trademarks*